US009017547B2

(12) United States Patent
Mehra et al.

(10) Patent No.: US 9,017,547 B2
(45) Date of Patent: Apr. 28, 2015

(54) HYDROGEN PURIFICATION FOR MAKE-UP GAS IN HYDROPROCESSING PROCESSES

(75) Inventors: Yuv R. Mehra, Dhahran (SA); Ali H. Al-Abdulai, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 1402 days.

(21) Appl. No.: 11/186,204

(22) Filed: Jul. 20, 2005

(65) Prior Publication Data

US 2007/0017851 A1 Jan. 25, 2007

(51) Int. Cl.

| | |
|---|---|
| ***C10G 47/00*** | (2006.01) |
| ***C10G 45/02*** | (2006.01) |
| ***C10G 45/58*** | (2006.01) |
| ***C10G 49/00*** | (2006.01) |

(52) U.S. Cl.

CPC ..... *C10G 49/007* (2013.01); *C10G 2300/1044* (2013.01); *C10G 2300/1051* (2013.01); *C10G 2300/1055* (2013.01); *C10G 2300/1074* (2013.01); *C10G 2300/1096* (2013.01); *C10G 2300/202* (2013.01); *C10G 2300/207* (2013.01); *C10G 2300/42* (2013.01); *C10G 2300/44* (2013.01)

(58) Field of Classification Search

USPC ..... 208/46, 49, 58, 177, 208 R, 209–217, 208/254 R, 254 H, 264

See application file for complete search history.

(56) References Cited

U.S. PATENT DOCUMENTS

| | | | | |
|---|---|---|---|---|
| 3,444,072 | A | 5/1969 | Lehman | C10G 13/00 |
| 3,598,722 | A | 8/1971 | Carson | C10G 13/00 |
| 3,666,658 | A | 5/1972 | Hallman | C10G 13/00 |
| 3,718,734 | A | 2/1973 | Christensen et al. | C01B 17/16 |
| 3,882,014 | A | 5/1975 | Monday et al. | C10G 3/04 |
| 4,362,613 | A | 12/1982 | MacLean | C10G 47/00 |
| 4,367,135 | A | 1/1983 | Posey, Jr. | C10G 47/00 |
| 4,457,834 | A | 7/1984 | Caspers et al. | C10G 49/22 |
| 4,617,038 | A | 10/1986 | Mehra | 62/17 |
| 4,692,179 | A | 9/1987 | Mehra | 62/17 |
| 4,740,222 | A | 4/1988 | Mehra | 72/17 |
| 4,743,282 | A | 5/1988 | Mehra | 62/17 |
| 4,832,718 | A | 5/1989 | Mehra | F25J 3/02 |
| 5,082,551 | A | 1/1992 | Reynolds et al. | C10G 67/02 |
| 5,414,168 | A | 5/1995 | Scott | C07C 7/20 |
| 5,462,583 | A | 10/1995 | Wood et al. | 95/192 |
| 5,546,764 | A | 8/1996 | Mehra | F25J 3/00 |
| 5,551,972 | A | 9/1996 | Wood et al. | B01D 47/14 |
| 5,687,584 | A | 11/1997 | Mehra | 62/632 |
| 6,153,086 | A | 11/2000 | Gupta et al. | 208/59 |
| 6,740,226 | B2 * | 5/2004 | Mehra et al. | 208/254 H |

OTHER PUBLICATIONS

Heckel et al., "The Unicracking Process Striving for Operational Excellence," National Petroleum Refiners Assoc., San Antonio, TX, Mar. 17, 1996.

Website www.chevron.com/prodserv/tema/isocracking-2C.htm, "Tailord Catalyst Systems," Sep. 17, 2001.

Website www.chevron.com/prodserv/tema/isocracking-2A.htm, "Isocracking," Sep. 17, 2001.

Website www.chevron.com/prodserv/tema/isocracking-2B.htm, "A Clear Upgrade Path," Sep. 17, 2001.

Website www.boucherandjones.com/hydrocracking, "HT Severe Hydrocracking-Clearly Superior," Sep. 18, 2001.

Groeneveld of AKZO Nobel Chemicals BV et al., "Adding Flexibility to Refining by Moderate Pressure Hydrocracking," Article, Sep. 18, 2001.

Website www.r-t-o-1.com/learning/studentguide/hcu.htm, "RTOL Students' Guide," Sep. 18, 2001.

Website www.syntroleum.com/news/2000PR/08232000.htm, "Syntroleum to Offer Refining Technology to Licensees," Syntroleum News, Sep. 18, 2001.

Froment et al., "Hydrotreatment and Hydrocracking of Oil Fractions," Studies in Surface Science and Catalysis, Feb. 17, 1997.

Website www.chevron.com/prodserv/tema/about-che-tech.htm, "About Chevron's Technology," Sep. 17, 2001.

Ayala, R.E., "Desulfurization of Hot Coal Gas," Article, Springer-Verlag Berin Heidelberg, Oct. 24, 1998.

* cited by examiner

*Primary Examiner* — Randy Boyer

(74) *Attorney, Agent, or Firm* — Abelman, Frayne & Schwab

(57) ABSTRACT

The recycle gas stream containing hydrogen that is part of the feedstream to a hydroprocessing reactor is mixed with the low purity make-up hydrogen and the sour flash gases upstream of the recycle gas compressor and compressed by the recycle gas compressor. The compressed gases pass through a methane and higher ($C_1$+) absorber to produce a sweet hydrogen recycle gas stream that is delivered to the hydroprocessing reactor at 96-98 mol % hydrogen. The process can be used to advantage in existing process facilities to increase the hydrogen partial pressure in the feedstream to the hydroprocessor where the existing recycle gas compressor is not designed for compressing the high purity hydrogen.

72 Claims, 3 Drawing Sheets

HYDROGEN PURIFICATION FOR MAKE-UP GAS IN HYDROPROCESSING PROCESSES

FIELD OF INVENTION

The present invention relates to a process for increasing the hydrogen partial pressure of recycled gas in hydroprocessing units, and specifically, to the treatment of low purity hydrogen streams as make-up hydrogen gas to hydroprocessing units.

BACKGROUND OF THE INVENTION

Hydroprocessing processes are common adjuncts to refining operations. These processes either enhance the value of lower-valued heavier, residual fuel oils (i.e., vacuum gas oil or VGO) or treat contaminant-laden refinery products (e.g., kerosene, diesel and gasoline). In hydroprocessing processes, the heavier or contaminated hydrocarbon products are co-processed with hydrogen to produce either higher-value products (such as gasoline from residual fuel oils) through hydrocracking operations or refinery products such as diesel and gasoline are upgraded to meet higher-quality, lower-contaminant specifications for such products through various hydrotreating processes, e.g., denitrogenation and desulfurization.

Hydrogen partial pressure is one of the most significant process variables in any hydroprocessing unit. It is defined as the product of hydrogen purity multiplied by the operating pressure of the hydroprocessing reactor. Increasing the hydrogen partial pressure results in improved catalyst performance, which in turn leads to a longer catalyst life-cycle, higher throughput capability, improved processing capability for heavier feeds, and better product quality.

The prior art includes process technology designed to significantly increase the partial pressure of hydrogen in hydroprocessing processes. One representative application of such technology is disclosed in U.S. Pat. No. 6,740,226, where the flashed gases from the high pressure separator typically containing about 78-83 mol % $H_2$ are fed to the bottom of an absorption column where the entering gases are counter-currently contacted with a lean solvent. The lean solvent absorbs the contained methane, $H_2S$, ethane, propane, butanes and pentanes from the contained hydrogen. The absorbed components in the rich solvent are separated by reducing the pressure and the heatless flash-regenerated lean solvent is returned to the top of the methane absorber column. In this process, the hydrogen purity of the overhead gases leaving the absorber is increased to 96-98 mol %. This purified recycle hydrogen stream is mixed with make-up $H_2$ to produce a combined stream with an overall purity that can be in the range of 96 to 99 mol % $H_2$. The improvement in hydrogen partial pressure significantly increases the overall throughput and efficiency of the hydroprocessing unit and can be effectively utilized for improving the performance of the hydrotreating, hydrodesulfurization, hydrodenitrogenation and hydrodealkylation reactor processes.

The process limitation of U.S. Pat. No. 6,740,226 relates to the potential surge conditions that can occur in existing recycle gas compressors at high hydrogen purity in the recycle gas, which lowers the molecular weight of the recycle gas to a value that is beyond the compressor design. At lower molecular weights (2-3), common to high purity hydrogen streams, existing compressors are unable to create the differential head needed to achieve the discharge pressure required by the hydroprocessing reaction. Consequently, the compressor is starved and is shutdown.

Due to the improved hydrogen purity in U.S. Pat. No. 6,740,226, the available mass of recycle gas for quenching the reactor effluent in the reactor is reduced in inverse proportion to the molecular weight (MW) reduction; i.e., a decrease in MW from >5 to 2-3 reduces the mass flow by a proportional two-fifths or three-fifths. This reduction requires an increase in the overall flow of the recycled hydrogen stream through the reactor, which adversely increases the space utilization within the reactor vessel and eventually reduces the throughput.

Additionally, the low hydrogen purity streams that are typically available in refineries cannot be used as make-up hydrogen gas without first subjecting the streams to separate purification steps that increase the mole-percent of hydrogen.

For existing hydroprocessing facilities, the process disclosed in U.S. Pat. No. 6,740,226 does not provide a solution to the problem of processing a high purity hydrogen recycle gas stream having a molecular weight between 2 and 3 if the recycle gas compressor has not been designed to handle low molecular weight of such a high purity. Since most of the prior art hydroprocessing units normally process 78-85 mol % hydrogen gases having average molecular weights greater than 5, the reduction in the molecular weight of the feed stream prevents the existing compressor from developing enough compression head to deliver the operating pressure required by the hydroprocessing reactor. To overcome this limitation, the compressor must be re-wheeled or replaced, either of which will incur a great expense and significant downtime. Failure to make the change to the compressor means the facility will not fully benefit from the increase in hydrogen purity that is obtainable by the incorporation of the absorption system of U.S. Pat. No. 6,740,226. Accordingly, this limits the utilization of the process of U.S. Pat. No. 6,740,226 to new hydroprocessing units or to those units that have the built-in flexibility to accommodate lower molecular weight, high-purity hydrogen recycle gas.

It is therefore an object of the present invention to provide a process and configuration of apparatus that can be utilized in existing hydroprocessing facilities having recycle gas compressors that cannot produce a high pressure feedstream from low molecular weight input streams.

Another object of the invention is to provide a process that is adapted for use in hydroprocessing systems of the prior art without the need for replacing or re-wheeling existing compressors.

An additional object of the invention is to provide a process that allows the use of low purity hydrogen streams available in a refinery as make-up hydrogen for the refinery's hydroprocessing reactors.

A further object of the invention is to provide means to minimize any changes to the quench gas mass flows for controlling the inlet temperature to the catalyst beds located in the hydroprocessing reactor.

SUMMARY OF THE INVENTION

The above objects and other advantages are achieved by locating the absorption-based hydrogen purification unit downstream of the recycle gas compressor.

The limitations and disadvantages of the prior art hydrogen purification processes for make-up gas streams in hydroprocessing processes are thus overcome by the present invention in which the hydrogen partial pressure is increased by increasing the hydrogen purity of the combined recycle gas and low purity hydrogen streams to 96-98 mol % by co-processing downstream of the recycle gas compressor.

The quench gas mass flow requirements are achieved by the process of the invention by using the compressed recycle gas with a MW>5 as the quench gas to the reactor sections before such gases are processed in the absorption system.

The process and apparatus of this invention are particularly applicable to existing systems having recycle gas compressors that are not designed for the higher level of the hydrogen purity that is attainable by use of the invention. In addition, the present process allows use of lower purity hydrogen streams available in the refinery from such units as continuous catalyst regeneration (CCR) and fixed-bed (FB) platformers, as well as the use of lower pressure flashed gases from the hydroprocessing units for the make-up hydrogen gas service. In fact, the process improvement of the invention permits any hydrogen-containing off-gases that may be available to be co-processed to recover hydrogen for use in the make-up hydrogen feedstream. Since the gas feed to the absorption system at >5 MW is available at the recycle gas compressor discharge pressure, the process of the invention overcomes the mass flow limitations for the quench gas system of the prior art process by utilizing the >5 MW gases as quench gas.

BRIEF DESCRIPTION OF THE DRAWINGS

The present invention will be readily understood by considering the following detailed description in conjunction with the accompanying drawings, in which.

To facilitate understanding, the same reference numerals have been used, when appropriate, to designate the same or similar elements that are common to the figures.

DETAILED DESCRIPTION OF THE INVENTION

Before describing the process of the invention in which the absorption-based hydrogen purification unit is located downstream of the recycle gas compressor, the process configuration of a prior art process will first be described for purposes of comparison.

Figure 1:
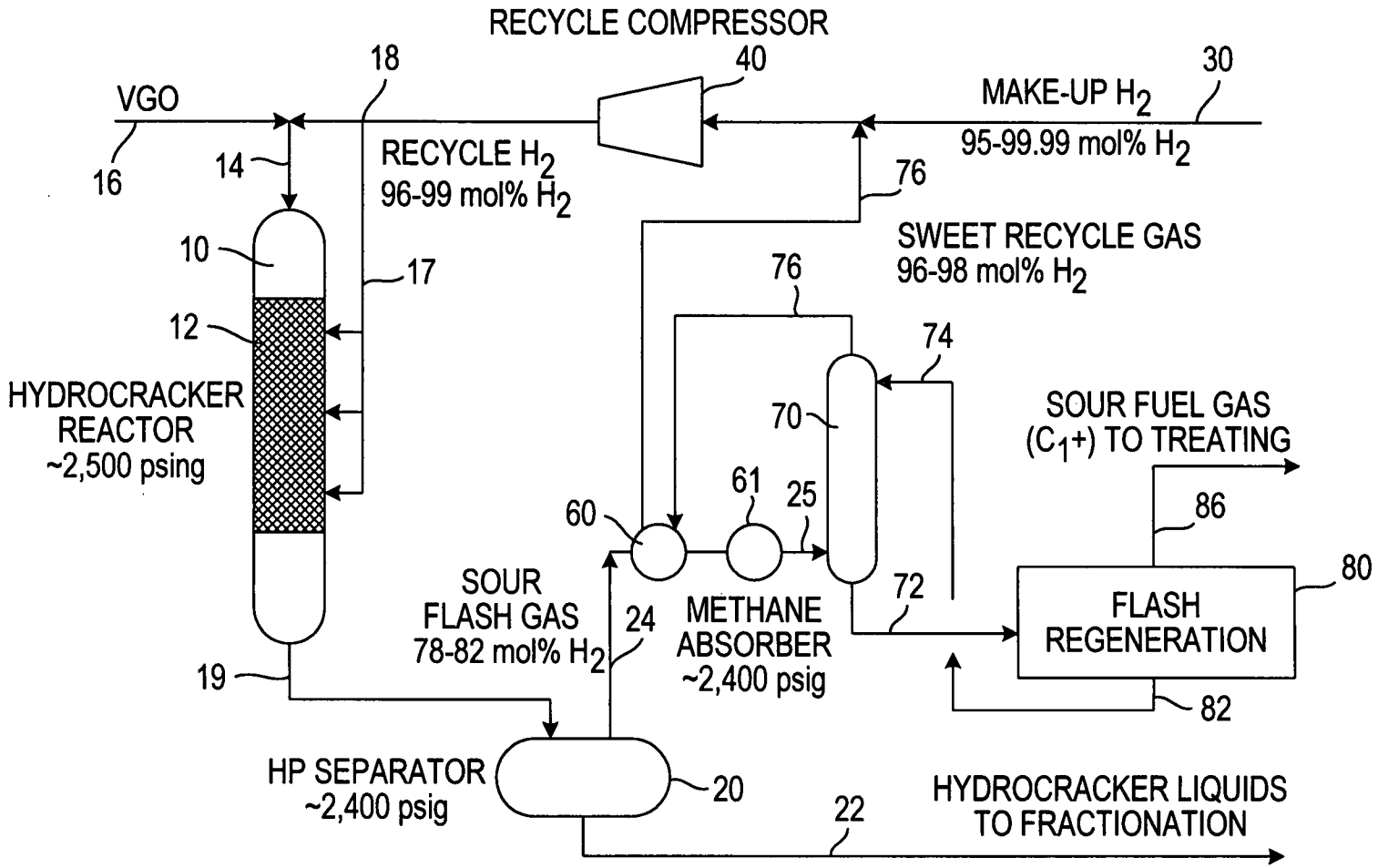
FIG. 1 is a schematic flow diagram of a prior art hydrogen purification system used in a hydrocracking process.

An example of the prior process of U.S. Pat. No. 6,740,226 applied to hydrocracking is schematically illustrated in FIG. 1. In the typical hydrocracking process, vacuum gas oil (VGO) stream 16 enters with a hydrogen stream 18 (derived from make-up hydrogen stream 30 and recycled hydrogen stream 76 compressed in compressor 40) as combined stream 14 to hydrocracker reactor 10 containing bed 12. A part of stream 18 is used as quench gas in stream 17 to control temperature in the catalytic beds 12. A reactor effluent stream 19 from reactor 10 is passed to a high pressure separator (HP separator) 20. The liquid stream 22 removed from the HP Separator 20 contains the hydrocracked products and is passed to product fractionation. The sour flashed gases 24 leaving the HP separator 20 at 78 mol % $H_2$ purity are countercurrently contacted with a lean solvent stream 76 to absorb the methane and heavier hydrocarbons away from the contained hydrogen. The separator gases are chilled by cross-exchanging with a colder, purified, recycled hydrogen stream 76 in a heat exchanger 60, followed by refrigeration unit 61 where they are cooled to about −20° F. To prevent any water present from freezing, ethylene glycol (EG) is injected on the tube side of these exchanges and an EG-$H_2O$ stream is separated in a three-phase coalescer/separator prior to the chilled gases and condensed liquids entering the methane absorber column 70. In this system, most of the $H_2O$ shed gases comprised of methane, ethane, propane, butanes and pentanes, are absorbed away from the contained hydrogen in stream 25. The rich liquid solvent stream 72 from the bottom of absorption zone 70 is passed to at least one flashing stage 80. Through pressure let down in flash drums, the flash gas stream 86 containing absorbed $C_1$+hydrocarbon components is separated to form the preferred lean liquid solvent stream 82 comprising $C_4$ and $C_5$ components that are present in the HP Separator gas stream 24. The temperature of the lean solvent stream 82 is lower than rich solvent stream 72. The cold lean solvent stream 82 is returned to the top of absorption zone 70 after being chilled in a refrigerant chiller (not shown) as the chilled lean solvent stream 74.

Figure 2:
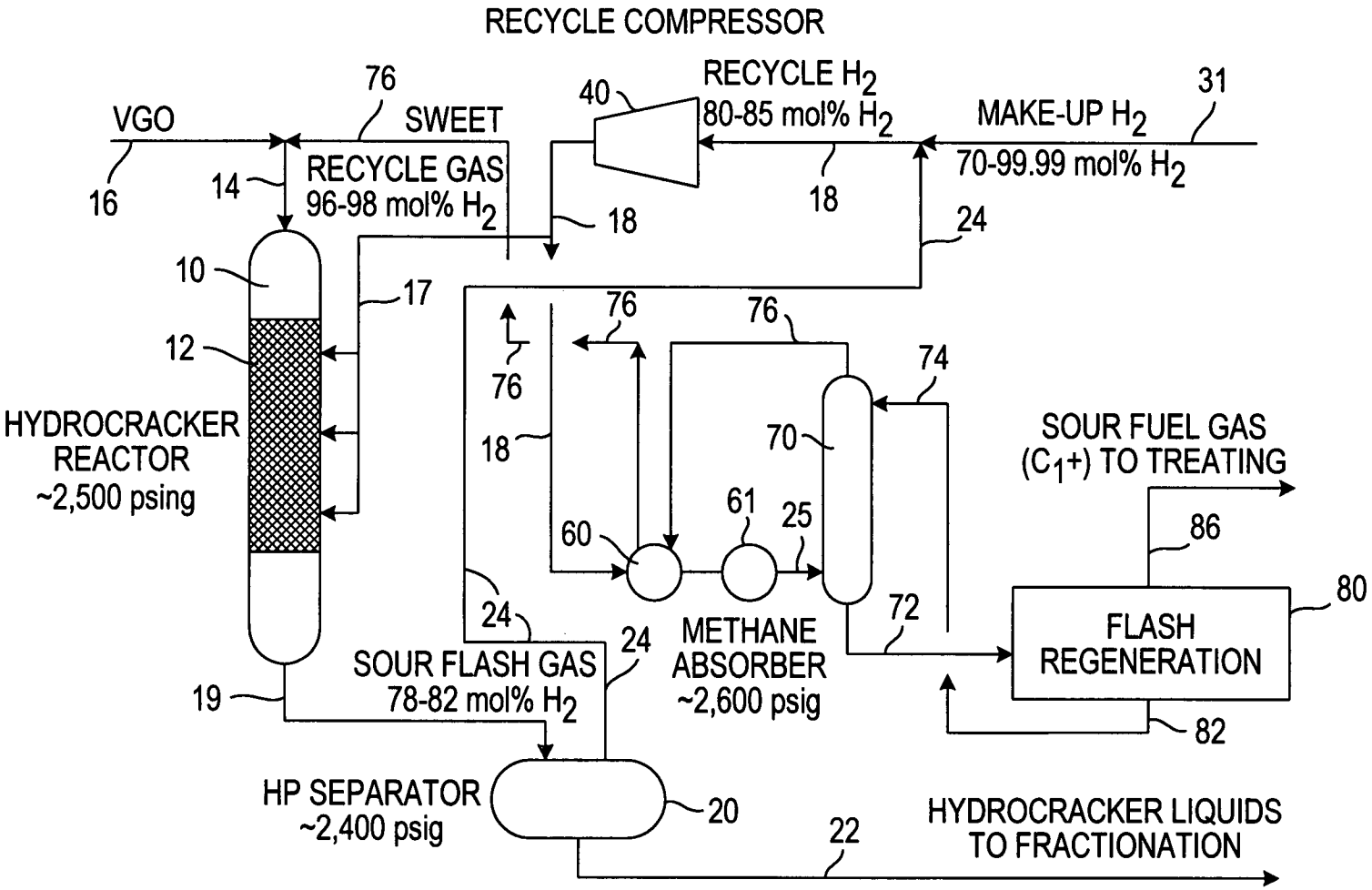
FIG. 2 is a schematic flow diagram of a first embodiment of a hydrocracking process of the present invention.
Figure 3:
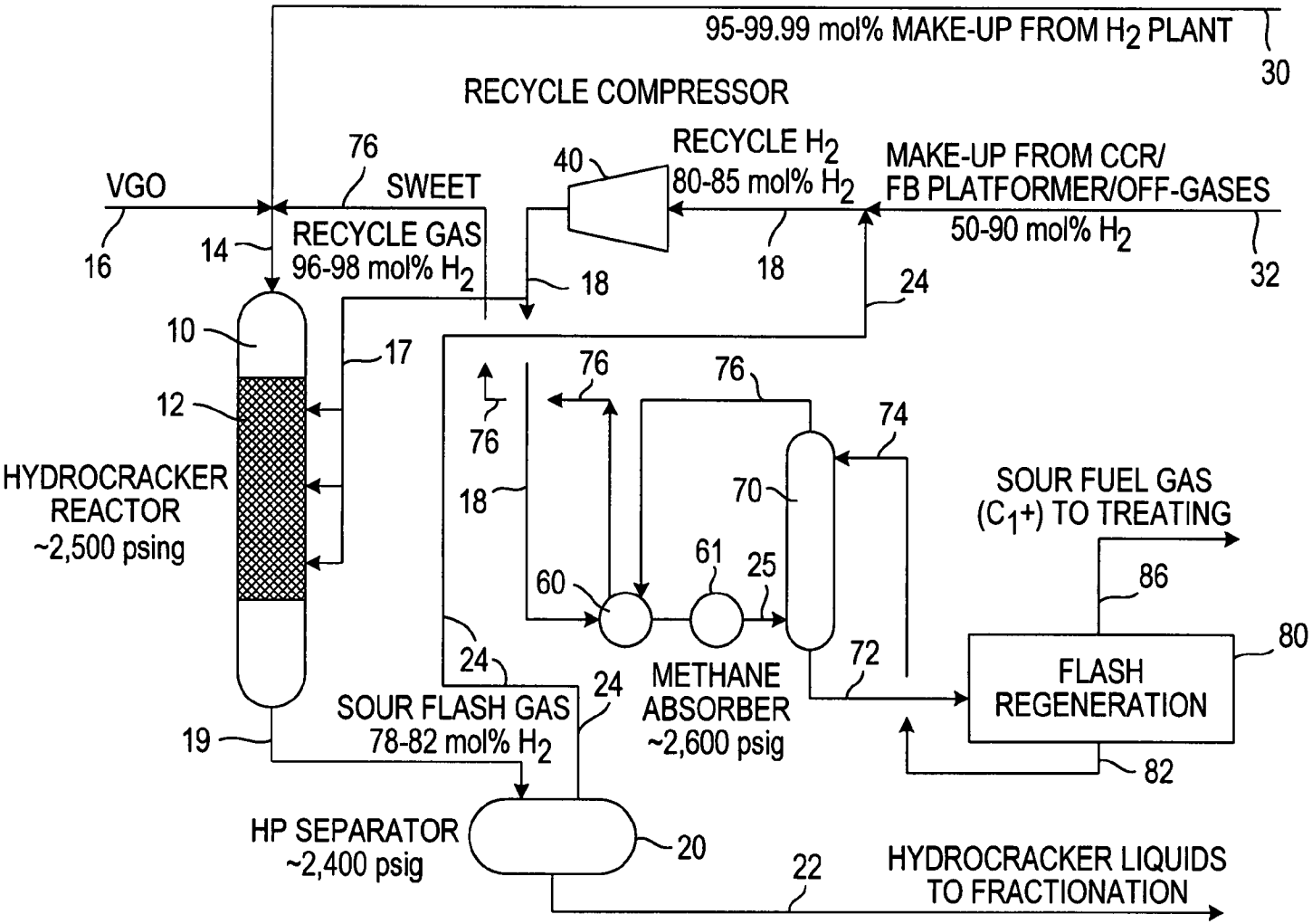
FIG. 3 is a flow diagram of a second embodiment of a hydrocracking process of the present invention.

As shown in FIGS. 2 and 3, the process of the invention utilizes an absorption column to remove methane and heavier components of the compressed recycle gas stream from the hydrogen-containing stream by absorption, thereby raising its purity to 96-98 mol % hydrogen. The preferred absorption solvent is comprised of the heavier components of the feed stream 18 that are separated in the solvent flash regeneration 80 as described under U.S. Pat. No. 6,740,226.

In the practice of the process of the invention, the methane and heavier components are absorbed and separated from the hydrogen at a slightly higher pressure, that is consistent with the discharge pressure of the recycle gas compressor, rather than the suction pressure of the recycle gas compressor. All other operating parameters of temperature and flash regeneration pressures are as described U.S. Pat. No. 6,740,226, which is herein incorporated in its entirety by reference.

This process also provides additional flexibility to use low purity hydrogen streams from CCR/FB platformer or flash gases from the hydroprocessing units as make-up hydrogen to the hydroprocessing units by co-processing these gases at a higher pressure downstream of the recycle gas compressor. Also, any hydrogen containing off-gases can be co-processed for recovery of hydrogen and addition to the make-up hydrogen gas stream.

As shown in FIG. 3, when high purity hydrogen (95-99.99 mol %) is available from a hydrogen source, such as steam reformer or gasification plant, this stream bypasses the recycle gas compressor to join the compressed sweet recycle gas that can include additional make-up hydrogen from lower purity sources such as CCR/fixed bed platformer, flashed gases from hydroprocessing units, or other off-gases available in the refinery (e.g., make-up hydrogen 32 in FIG. 3, which can range from 50-90 mol % $H_2$, make-up hydrogen 31 in FIG. 2, which can range from 70-99.99 mol % $H_2$).

Thus, the invention overcomes a significant limitation common to existing hydroprocessing units in which the existing recycle gas compressors are not designed to handle higher purity hydrogen streams.

In new facilities, recycle gas compressors can be installed for compressing high purity-low molecular weight (2-3) gases. Existing recycle gas compressors designed to handle significantly higher hydrogen purities (88-96 mol %) can be utilized without significant modifications for the practice of the process of the invention. As noted above, in order to fully realize the benefits from achieving the purification capabilities of 96-98 mol % hydrogen by the process of U.S. Pat. No. 6,740,226, either the existing recycle gas compressor needs to be re-wheeled or replaced; in lieu of which it is necessary to limit the hydrogen purity increase to the design capability of the compressor, which is typically 88-96 mol % hydrogen. Operating the recycle gas compressor at hydrogen purities higher than the compressor design may subject the recycle gas compressor to surge conditions.

The process and configuration of the apparatus of the present invention overcomes the surge limitations of the existing recycle gas compressors since there is little change, if any, in the recycle gas purity before compression and provides the hydroprocessing unit with the highest possible hydrogen partial pressure to thereby significantly improve the overall efficiency and performance of the hydroprocessing catalyst.

The second limitation that is overcome by the present invention relates to the inability to recover additional hydrogen from refinery off-gases or CCR/FB platformer units for make-up use without further purification. With this invention process, such streams containing as little as 50 mol % $H_2$ can be introduced directly as a make-up hydrogen stream for co-processing with recycle gas stream without adversely impacting the performance of the hydroprocessing catalyst.

The third limitation of required mass flow of quench gas is overcome by using the compressed recycle gas having >5 MW in lieu of 2-3 MW gases in prior art processes (see location of stream 17 and its relative hydrogen purity).

The improved process of the invention significantly expands the commercial capabilities for increasing the partial pressure of hydrogen in prior art hydroprocessing facilities.

Although various embodiments of the present invention have been illustrated and described in detail, other embodiments will be apparent to those skilled in the art and the scope of the invention is to be determined with reference to the claims that follow.

We claim:

1. A process for hydrogenating a feedstream in a hydroprocessing reactor, the feedstream comprising a heavy hydrocarbon liquid component, the reactor also receiving a hydrogen gas input component, the reactor producing a reactor effluent, the process comprising:

a. separating the reactor effluent with a high pressure separator into an effluent liquid stream and an effluent gas stream, the effluent gas stream comprising unreacted hydrogen, methane and heavier hydrocarbons;

b. compressing the effluent gas stream from the high pressure separator and a make-up hydrogen gas stream in a recycle gas compressor to produce a compressed recycle gas stream containing unreacted hydrogen, methane and heavier hydrocarbons from the effluent gas stream, and make-up hydrogen from the make-up hydrogen gas stream;

c. cooling the compressed recycle gas stream to a temperature in the range of +30° F. (−1.1° C.) to −40° F. (−40° C.);

d. contacting the cooled compressed recycle gas stream with a lean liquid solvent stream comprising $C_4$ to $C_5$ hydrocarbon components in an absorption zone to absorb the methane and heavier hydrocarbons from the compressed recycle gas stream to produce a hydrogen-rich gas stream containing 90 to 99 mol% hydrogen and a rich liquid solvent stream;

e. recovering the hydrogen-rich gas stream from the absorption zone;

f. adding the hydrogen-rich gas stream to the hydroprocessing reactor feedstream as the hydrogen gas input component; and g. flashing the rich liquid solvent stream in at least one flashing stage to produce the lean liquid solvent stream comprising $C_4$ to $C_5$ hydrocarbon components for contacting the cooled compressed recycle gas stream in step (d), and to produce a methane and heavier hydrocarbons gas product stream.

2. The process of claim 1, wherein the hydroprocessing reactor is selected from the group consisting of hydrodesulfurization, hydrocracking, hydrodenitrification, hydrodealkylation and hydrotreating reactors.

3. The process of claim 2, wherein the reactor is a hydrocracking reactor operating at a pressure in the range of 500 psig (35.1 kg/cm$^2$g) to 5,000 psig (351.5 kg/cm$^2$g).

4. The process of claim 3, wherein the hydrocracking reactor is operated at a pressure in the range of 1,000 psig (70.3 kg/cm$^2$g) to 3,000 psig (210.9kg/cm$^2$g).

5. The process of claim 2, wherein the reactor is selected from the group consisting of hydrodealkylation and hydrotreating, and the reactor is operated at a pressure in the range of 200 psig (14.1 kg/cm$^2$g) to 3,000 psig (210.9 kg/cm$^2$g).

6. The process of claim 2, wherein the high pressure separator is operated at a pressure in the range of 200 psig (14.1 kg/cm$^2$g) to 5,000 psig (351.5 kg/cm$^2$g).

7. The process of claim 2, wherein the compressed recycle gas stream and lean liquid solvent stream are contacted in the absorption zone at a pressure in the range of 200 psig (14.1 kg/cm$^2$g) to 5,000 psig (351.5 kg/cm$^2$g).

8. The process of claim 7, wherein the compressed recycle gas stream and lean liquid solvent stream are contacted in the absorption zone at a pressure in the range of 200 psig (14.1 kg/cm$^2$g) to 3,000 psig (210.9 kg/cm$^2$g).

9. The process of claim 1, wherein the hydrogen gas input component of the reactor feed stream contains 90-99 mol % hydrogen.

10. The process of claim 1, wherein the hydrogen gas input component includes a separate high purity make-up gas stream.

11. The process of claim 10, wherein the high-purity make-up gas stream contains 95-99.99 mol% hydrogen.

12. The process of claim 1, wherein the effluent gas stream from the high pressure separator is mixed with a low purity make-up gas stream and compressed in the recycle gas compressor to form the compressed recycle gas stream.

13. The process of claim 1, wherein the compressed recycle gas stream is comprised of compressed effluent gas stream and a compressed low purity make-up gas stream.

14. The process of claim 1, wherein a portion of the gas stream exiting the recycle gas compressor is fed directly to the reactor as a quench gas stream to maintain the temperature of the catalyst in the reactor within a predetermined range.

15. The process of claim 12, wherein the low purity make-up gas stream contains 50-99.99 mol% hydrogen.

16. The process of claim 12, wherein the low purity make-up gas stream contains 70-99.99 mol% hydrogen.

17. The process of claim 15, wherein the low purity make-up gas stream contains 50-90 mol% hydrogen.

18. The process of claim 2, wherein the heavy hydrocarbon liquid component feed contains sulfur, and the methane and heavier hydrocarbon gas product stream obtained in step (g) contains hydrogen sulfide, the process including the further steps following step (g) of:

h. contacting the methane and heavier hydrocarbon gas product with a lean amine solution in a treatment zone for removing the hydrogen sulfide and thereby providing a sweetened methane and heavier hydrocarbon gas product;

i. recovering the hydrogen sulfide-rich amine solution from the treatment zone; and j. passing the hydrogen sulfide-rich amine solution through a regeneration column for producing a lean amine solution for contacting in step (g).

19. The process of claim 1, wherein the compressed recycle gas stream is cooled to a temperature between 0° F. (−17.9° C.) and −20° F. (−28.9° C.).

20. The process of claim 19, wherein the compressed recycle gas stream is cooled to a temperature between −10° F. (−23.3° C.) to −15° F. (−26.1° C.).

21. The process of claim 1, wherein the compressed recycle gas stream contains water and the compressed recycle gas stream is co-chilled with ethylene glycol and the ethylene glycol/water mixture is separated from the chilled hydrocarbon gas and hydrocarbon liquid streams prior to entering the absorber.

22. The process of claim 1, wherein the heavy hydrocarbon component is selected from the group consisting of naphtha, kerosene, diesel, light vacuum gas oil, heavy vacuum gas oil, de-metalized oil, coker gas oil, resid, fuel oil and aromatics.

23. The process of claim 1, wherein the recovered hydrogen-rich gas stream from the absorption zone is further cross heat exchanged with the compressed recycle gas stream.

24. The process of claim 1, wherein the cooled compressed recycle gas stream is contacted in step (c) with the lean liquid solvent stream in counter-current flow.

25. The process of claim 1, wherein the lean liquid solvent stream enters the absorption zone at a temperature in the range of +30° F. (−1.1° C.) to −40° F.(−40° C.).

26. The process of claim 25, wherein the lean liquid solvent stream enters the absorption zone at a temperature in the range of 0° F. (−17.8° C.) to −20° F. (−28.9° C.).

27. The process of claim 26, wherein the lean liquid solvent stream enters the absorption zone at a temperature in the range of −10° F. (−23.3° C.) to −15° F. (−26.1° C.).

28. The process of claim 1, wherein the rich liquid solvent stream passes through at least two successive flash separators.

29. The process of claim 28, wherein the separated gases from the first of the at least two successive flash separators are compressed and returned to the absorption zone of step (d).

30. The process of claim 28, wherein the at least two flash separators are at least two-phase gas-liquid separation drums.

31. The process of claim 28, wherein the at least two successive flash separators operate at successively lower pressures than the operating pressure in the absorption zone.

32. The process of claim 6, wherein the effluent liquid stream from the high pressure separator is let down in pressure to produce a low pressure liquid and gas stream.

33. The process of claim 32, wherein the low pressure liquid and gas stream are separated in a low pressure separator to produce a low pressure hydrogen-rich gas stream.

34. The process of claim 33, further comprising:

compressing and chilling the low pressure hydrogen-rich gas stream derived from the low pressure separator and passing the compressed and chilled stream to the absorption zone of step (d) for co-processing.

35. The process of claim 10, wherein the separate high purity make-up hydrogen gas stream bypasses the recycle gas compressor.

36. The process of claim 1, wherein the compressed recycle gas stream in step (b) contains up to 85 mol % hydrogen.

37. A process for hydrogenating a feedstream in a hydroprocessing reactor, the feedstream comprising a heavy hydrocarbon liquid component, the reactor also receiving a hydrogen gas input component, the reactor producing a reactor effluent, the process comprising:

a. separating the reactor effluent with a high pressure separator into an effluent liquid stream and an effluent gas stream, the effluent gas stream comprising unreacted hydrogen, methane and heavier hydrocarbons;

b. compressing the effluent gas stream and a make-up hydrogen gas stream in a recycle gas compressor designed to compress gases with average molecular weights greater than five to produce a compressed recycle gas stream containing unreacted hydrogen, methane and heavier hydrocarbons from the effluent gas stream, and make-up hydrogen from the make-up hydrogen gas stream;

c. cooling the compressed recycle gas stream to a temperature in the range of +30° F. (−1.1° C.) to −40° F. (−40° C.);

d. contacting the cooled compressed recycle gas stream with a lean liquid solvent stream comprising $C_4$ to $C_5$ hydrocarbon components in an absorption zone to absorb the methane and heavier hydrocarbons from the compressed recycle gas stream to produce a hydrogen-rich gas stream containing 90 to 99 mol% hydrogen having an average molecular weight between two and three and a rich liquid solvent stream;

e. recovering the hydrogen-rich gas stream from the absorption zone;

f. adding the hydrogen-rich gas stream to the hydroprocessing reactor feedstream as the hydrogen gas input component; and g. flashing the rich liquid solvent stream in at least one flashing stage to produce the lean liquid solvent stream comprising $C_4$ to $C_5$ hydrocarbon components for contacting the cooled compressed recycle gas stream in step (d), and to produce a methane and heavier hydrocarbons gas product stream.

38. The process of claim 37, wherein the hydroprocessing reactor is selected from the group consisting of hydrodesulfurization, hydrocracking, hydrodenitrification, hydrodealkylation and hydrotreating reactors.

39. The process of claim 38, wherein the reactor is a hydrocracking reactor operating at a pressure in the range of 500 psig (35.1 kg/cm$^2$g) to 5,000 psig (351.5kg/cm$^2$g).

40. The process of claim 39, wherein the hydrocracking reactor is operated at a pressure in the range of 1,000 psig (70.3 kg/cm$^2$g) to 3,000 psig (210.9 kg/cm$^2$g).

41. The process of claim 38, wherein the reactor is selected from the group consisting of hydrodealkylation and hydrotreating, and the reactor is operated at a pressure in the range of 200 psig (14.1 kg/cm$^2$g) to 3,000 psig (210.9 kg/cm$^2$g).

42. The process of claim 38, wherein the high pressure separator is operated at a pressure in the range of 200 psig (14.1 kg/cm$^2$g) to 5,000 psig (351.5 kg/cm$^2$g).

43. The process of claim 38, wherein the compressed recycle gas stream and lean liquid solvent stream are contacted in the absorption zone at a pressure in the range of 200 psig (14.1 kg/cm$^2$g) to 5,000 psig (351.5 kg/cm$^2$g).

44. The process of claim 43, wherein the compressed recycle gas stream and lean liquid solvent stream are contacted in the absorption zone at a pressure in the range of 200 psig (14.1 kg/cm$^2$g) to 3,000 psig (210.9 kg/cm$^2$g).

45. The process of claim 37, wherein the hydrogen gas input component of the reactor feed stream contains 90-99 mol % hydrogen.

46. The process of claim 37, wherein the hydrogen gas input component includes a separate high purity make-up gas stream.

47. The process of claim 46, wherein the high-purity make-up gas stream contains 95-99.99 mol % hydrogen.

48. The process of claim 37, wherein the effluent gas stream from the high pressure separator is mixed with a low purity make-up gas stream and compressed in the recycle gas compressor to form the compressed recycle gas stream.

49. The process of claim 37, wherein the compressed recycle gas stream is comprised of compressed effluent gas stream and a compressed low purity make-up gas stream.

50. The process of claim 37, wherein a portion of the gas stream exiting the recycle gas compressor is fed directly to the reactor as a quench gas stream to maintain the temperature of the catalyst in the reactor within a predetermined range.

51. The process of claim 48, wherein the low purity make-up gas stream contains 50-99.99 mol % hydrogen.

52. The process of claim 48, wherein the low purity make-up gas stream contains 70-99.99 mol % hydrogen.

53. The process of claim 51, wherein the low purity make-up gas stream contains 50-90 mol % hydrogen.

54. The process of claim 38, wherein the heavy hydrocarbon liquid component feed contains sulfur, and the methane and heavier hydrocarbon gas product stream obtained in step (g) contains hydrogen sulfide, the process including the further steps following step (g) of:

h. contacting the methane and heavier hydrocarbon gas product with a lean amine solution in a treatment zone for removing the hydrogen sulfide and thereby providing a sweetened methane and heavier hydrocarbon gas product;

i. recovering the hydrogen sulfide-rich amine solution from the treatment zone; and j. passing the hydrogen sulfide-rich amine solution through a regeneration column for producing a lean amine solution for contacting in step (g).

55. The process of claim 37, wherein the compressed recycle gas stream is cooled to a temperature between 0° F. (−17.9° C.) and −20° F. (−28.9° C.).

56. The process of claim 55, wherein the compressed recycle gas stream is cooled to a temperature between −10° F. (−23.3° C.) to −15° F. (−26.1° C.).

57. The process of claim 37, wherein the compressed recycle gas stream contains water and the compressed recycle gas stream is co-chilled with ethylene glycol and the ethylene glycol/water mixture is separated from the chilled hydrocarbon gas and hydrocarbon liquid streams prior to entering the absorber.

58. The process of claim 37, wherein the heavy hydrocarbon component is selected from the group consisting of naphtha, kerosene, diesel, light vacuum gas oil, heavy vacuum gas oil, de-metalized oil, coker gas oil, resid, fuel oil and aromatics.

59. The process of claim 37, wherein the recovered hydrogen-rich gas stream from the absorption zone is further cross heat exchanged with the compressed recycle gas stream.

60. The process of claim 37, wherein the cooled compressed recycle gas stream is contacted in step (c) with the lean liquid solvent stream in counter-current flow.

61. The process of claim 37, wherein the lean liquid solvent stream enters the absorption zone at a temperature in the range of +30° F. (−1.1° C.) to −40° F. (−40° C.).

62. The process of claim 61, wherein the lean liquid solvent stream enters the absorption zone at a temperature in the range of 0° F. (−17.8° C.) to −20° F. (−28.9° C.).

63. The process of claim 62, wherein the lean liquid solvent stream enters the absorption zone at a temperature in the range of −10° F. (−23.3° C.) to −15° F. (−26.1° C.).

64. The process of claim 37, wherein the rich liquid solvent stream passes through at least two successive flash separators.

65. The process of claim 64, wherein the separated gases from the first of the at least two successive flash separators are compressed and returned to the absorption zone of step (d).

66. The process of claim 64, wherein the at least two flash separators are at least two-phase gas-liquid separation drums.

67. The process of claim 64, wherein the at least two successive flash separators operate at successively lower pressures than the operating pressure in the absorption zone.

68. The process of claim 42, wherein the effluent liquid stream from the high pressure separator is let down in pressure to produce a low pressure liquid and gas stream.

69. The process of claim 68, wherein the low pressure liquid and gas stream are separated in a low pressure separator to produce a low pressure hydrogen-rich gas stream.

70. The process of claim 69, further comprising:

compressing and chilling the low pressure hydrogen-rich gas stream derived from the low pressure separator and passing the compressed and chilled stream to the absorption zone of step (d) for co-processing.

71. The process of claim 46, wherein the separate high purity make-up hydrogen gas stream bypasses the recycle gas compressor.

72. The process of claim 37, wherein the compressed recycle gas stream in step (b) contains up to 85 mol % hydrogen.

* * * * *